US005249373A

United States Patent [19]

Rogne et al.

[11] Patent Number: 5,249,373

[45] Date of Patent: Oct. 5, 1993

[54] WEB THREADING SYSTEM

[75] Inventors: Allan W. Rogne, Two Rivers; Dennis M. Theyerl, Whitelaw, both of Wis.

[73] Assignee: W. R. Grace & Co.-Conn., New York, N.Y.

[21] Appl. No.: 939,574

[22] Filed: Sep. 3, 1992

Related U.S. Application Data

[63] Continuation of Ser. No. 647,224, Jan. 29, 1991, abandoned.

[51] Int. Cl.[5] ..... F26B 13/10

[52] U.S. Cl. ..... 34/120; 34/158; 34/162; 34/163; 226/91; 226/92

[58] Field of Search ..... 34/155, 156, 158, 162, 34/163, 120, 117; 226/91, 92; 162/193

[56] References Cited

U.S. PATENT DOCUMENTS

| | | | |
|---|---|---|---|
| 1,670,873 | 5/1928 | Avenson | 34/120 |
| 2,862,705 | 12/1958 | Faeber | 34/120 |
| 2,944,345 | 1/1959 | Faeber | 34/56 |
| 3,085,346 | 4/1963 | Allander et al. | 34/156 |
| 3,127,079 | 3/1964 | Allander | 34/120 |
| 3,199,219 | 8/1965 | Brauer et al. | 34/120 |
| 3,346,159 | 10/1967 | Winkler | 34/120 |
| 3,508,342 | 4/1970 | Levtchouk et al. | 34/120 |
| 3,626,603 | 12/1971 | Breyer | 34/156 |
| 3,643,343 | 2/1972 | Marchal | 34/120 |
| 3,922,752 | 12/1975 | Holm | 34/120 |
| 3,955,553 | 12/1976 | Winterholler et al. | 101/228 |
| 4,015,793 | 4/1977 | Hemminger | 242/74 |
| 4,070,965 | 1/1978 | Acnishaenslin et al. | 101/228 |
| 4,079,877 | 3/1978 | McAnespie et al. | 226/92 |
| 4,226,382 | 10/1980 | Watanabe | 242/74 |
| 4,309,830 | 1/1982 | Vits | 34/156 |
| 4,404,907 | 9/1983 | Kobler et al. | 101/228 |
| 4,819,557 | 4/1989 | Handschuher | 101/228 |
| 4,840,322 | 6/1989 | Masuda et al. | 242/67.1 R |

*Primary Examiner*—Henry A. Bennet
*Assistant Examiner*—Denise L. Gromada
*Attorney, Agent, or Firm*—Kevin S. Lemack; William L. Baker; Hugh D. Jaeger

[57] ABSTRACT

A web threading system for threading a web through a dryer and an optional chill roll stand. The web attaches to a lock up roll threading bar. A lock up roll threading bar is carried between a pair of parallel dryer chains to lead and thread the web through the dryer environment, and through and about optional chill rolls in a chill stand. A locking mechanism is provided for the lock up roll threading bar to engage the web for ready attachment or disengagement of the web from the lock up roll threading bar before and after the threading process.

12 Claims, 4 Drawing Sheets

WEB THREADING SYSTEM

This is a continuation of co-pending application Ser. No. 07/647,224, filed on Jan. 29, 1991, now abandoned.

BACKGROUND OF THE INVENTION

1. Field of the Invention

The present invention relates to threading a web through a dryer, and more particularly, pertains to attaching a web to a lock up roll threading bar for threading the web through a heated dryer and an optional chill roll stand.

2. Description of the Prior Art

The prior art process for feeding and threading a web through a dryer was a "brute force" procedure of one or two people manually threading a web between air bars of a dryer. If the dryer had been operating, then the procedure was compounded by hot components in the dryer including the air bars, the ducts, the frame and all of the inner and outer structural components. People would tend to be affected by the heat if the dryer had been previously operated, and possibly even burned on touching any heated components.

The present invention overcomes the disadvantages of the prior art by providing a high temperature web thread system including at least one lock up roll for threading a web through a dryer and an optional chill roll stand.

SUMMARY OF THE INVENTION

The general purpose of the present invention is a system for threading a web through a web dryer and an optional chiller roll stand. Parallel spring loaded stainless steel dryer chains track over sprockets at each end and the sides of a web dryer and an optional chill roll stand. Upper and lower guide rails support and guide the stainless steel dryer chains through the heated interior environment of the dryer and along the bottom framework of the dryer, respectively. The ends of a lock up roll threading bar are connected between the parallel dryer chains. The lock up roll threading bar includes a horizontally aligned slot through the center for accommodation of a web end. A spring loaded locking cog mechanism locks or unlocks and lock up a threading roller to central spindle shafts to allow a roller to be ultimately secured and locked to the central spindle shafts or to free wheel about the central spindle shafts.

According to one embodiment of the present invention, there is provided a web threading system including a set of continuous parallel dryer chains which are driven and which travel through a dryer and an optional chill stand along a system of sprockets, upper and lower guide rails, and about the ends of a dryer. A lock up roll threading bar aligns between the dryer chains and is moved along with an attached web through the interior of the dryer, about the optional chill rolls and back to the entry end of the dryer by the parallel dryer chains.

The process is that a web is inserted into a slot of the lock up roll threading bar and rotated in the unlocked position to wind a web about its circumference, after which the spring locking cog mechanism is engaged into locking notches. The locked roll threading bar is propelled by the dryer chains carrying the web through the length of the dryer and around and about the chill rolls in a chill stand after which the locked up roll threading bar automatically stops and is unlocked to be unwound from the lock up roll threading bar.

One significant aspect and feature of the present invention is a lock up roll threading bar for the attachment to one end of a web.

Another significant aspect and feature of the present invention is a lock up roll threading bar which can be locked or which can free wheel.

A further significant aspect and feature of the present invention is a lock up roll threading bar with locking tabs which engage a cylindrical roll.

An additional significant aspect and feature of the present invention is a dryer chain system for carriage of an attached lock up roll threading bar through a dryer and an optional chill roll.

Having thus described one embodiment of the present invention, it is the principal object hereof to provide a web threading system for including a lock up roll threading bar for threading of a web through a dryer and an optional chill stand by the dryer.

One object of the present invention is a structure to thread a web through a dryer and about a chill roll stand.

Another object of the present invention is a process for automatically threading a web through a dryer.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
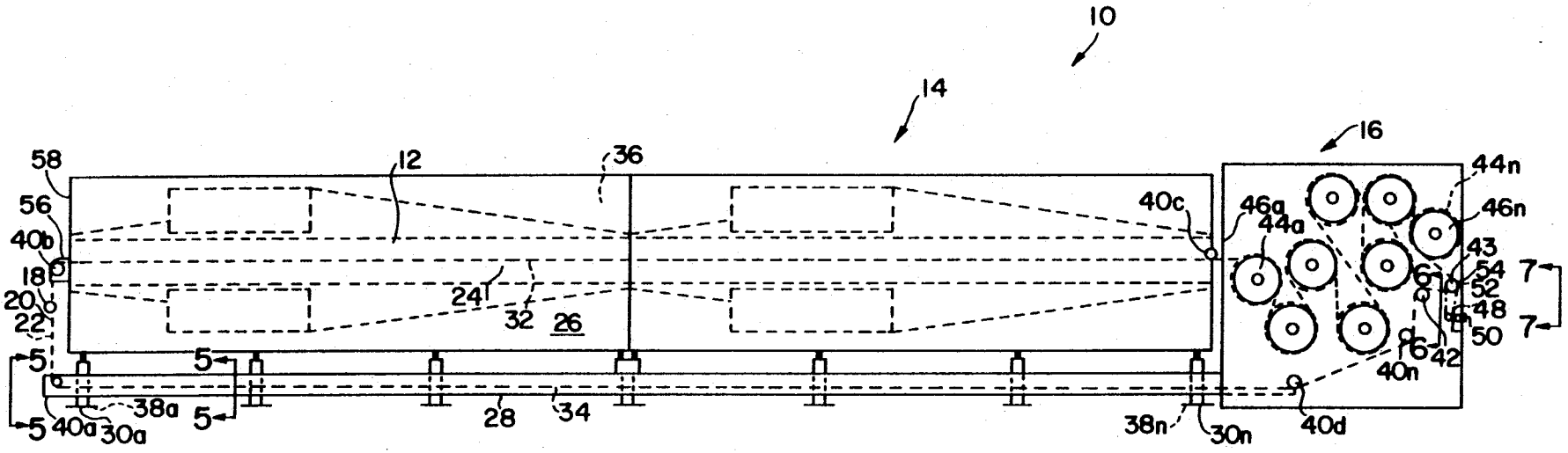
FIG. 1 illustrates a side view in cross section of a web threading system, the present invention.

FIG. 1 illustrates a side view in cross section of a web threading system 10 for the threading of a web 12 through a dryer 14 and an optional chill stand 16. The system includes a look up roll threading bar 18 suspended between parallel continuous front and rear dryer chains 20 and 22. An upper chain support rail 24 is located on the inside of the rear face 26 of the dryer 14 and a lower chain support rail 28 is located beneath the upper chain support rail 24 and exterior to the dryer 14 adjacent to a plurality of support legs 30*a*–30*n*. Similar corresponding parallel upper chain support rails 32 and a lower chain support rail 34 beneath the upper chain support rail 32 are aligned across from the upper support rail 24 and lower support rail 28, and are respectively located on a rear face 36 of the dryer 14 and adjacent to a plurality of rear support legs 38a–38n. A plurality of idler sprockets 40a–40n position on the rear side 26 of the dryer 14 and the chill stand 16. Corresponding similar idler sprockets are likewise positioned on the rear face 36 of the dryer 14 and the chill stand 16, and are not illustrated for purposes of clarity and brevity.

The front continuous dryer chain 20 rests in the upper chain guide system 24 and the lower chain guide 28 and over and about idler sprockets 40a–40n as illustrated. The continuous front dryer chain 20 also traverses over a take up sprocket 42, a drive sprocket 43 and dryer chill roll sprockets 44a–44n on chill rolls 46a–46n. A chain 48 is driven by a motor 50 to propel a limiter torque sprocket 52 and a drive shaft 54. The drive shaft 54 actuates the rear continuous parallel dryer chain 22 and is further illustrated in FIG. 7. A limit switch 56 is located below the idler sprocket 40b on the side wall 58 of the dryer 14.

Figure 2:
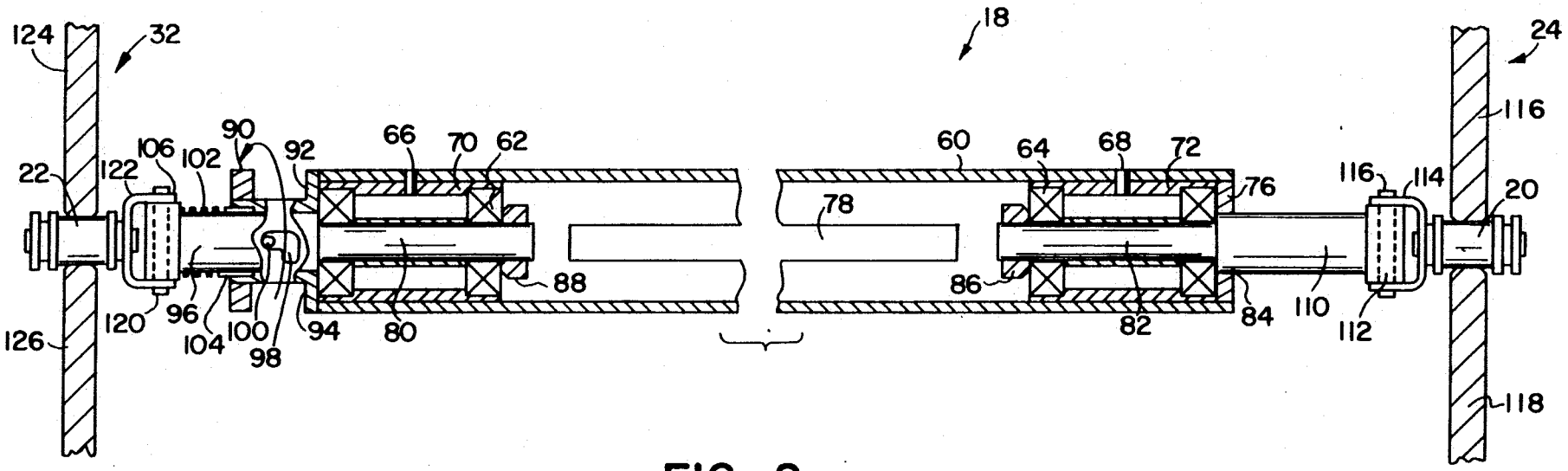
FIG. 2 illustrates a sectional view of a lock up roll threading bar.

FIG. 2 illustrates a sectional view of the lock up roll threading bar 18 where all numerals correspond to those elements previously described. The lock up roll threading bar 18 includes a cylindrical roll 60 mounted on bearings 62 and 64, and secured thereto by pins 66 and 68 through the cylindrical roll 60 and into the body of the bearing housings 70 and 72, respectively. The cylindrical roll 60 includes a horizontally aligned slot 78 for accommodation of web material as later described in detail. Multi-radius spindle shafts 80 and 82 align through the bearings 62 and 64, respectively. The multi radius spindle shaft 82 extends through the bearing 64, and secures therein by a lock nut and washer assembly 86. The cylindrical roll 60 is free wheeling with respect to the multi radius spindle shaft 82.

The opposing multi radius spindle shaft 80 extends through the bearing 62, and secures thereto by a lock nut and washer assembly 88. The cylindrical roll 60 can be either free wheeling with respect to the multi radius shaft 80 or can be locked together so that the multi radius shaft 80 and the cylindrical roll 60 are stationary.

A center bored knurled lock up knob 90 with locking tabs 92 and 94 slides horizontally along and about the larger radius 96 of the multi radius spindle shaft 80. The center bored knurled lock up knob 90 includes a right angle twist lock slot 98 aligned about a pin 100 extending perpendicularly from the radius 96 of the spindle shaft 80. The locking tabs 92 and 94 in the knurled lock up knob 90 secure into grooves 128–134 in the cylindrical roll 60 as described in detail in FIG. 3. The bearing 62 is set back into the cylindrical roll 60 sufficiently to allow the radius 63 of the knurled lock up knob 90, and the locking tabs 92 and 94 to align with the grooves 128–134 in the cylindrical roll 60. A spring 102 is compressed between an annular groove 104 in the interior of the knurled lock up knob 90 and the largest radius portion 106 of the multi radius spindle shaft 80 to force the members of the knurled lock up knob 90 and the locking tabs 92 and 94 against the adjacent grooved end of the cylindrical roll 60 so that the multi radius spindle shaft 80 is locked to the cylindrical roll 60. Free wheeling of the cylindrical roll 60 is accomplished by disengaging the knurled lock up knob 90 and the locking tabs 92 and 94 from the cylindrical roll 60 by rotating the lock up knob 90 as indicated by the arrow 108 after first sliding the lock up knob 90 to the left. The lock up mechanism is further illustrated in FIG. 3. The multi radius spindle shaft 82 also includes radiuses 110 and 112 corresponding to radius 96 and 106 of the multi radius spindle shaft 80. The largest radius 112 of the multi radius spindle shaft 82 secures to a special "U"-shaped chain link 114 of the dryer chain 20 by a pin 116 through the radius 112 and the link 114. Special chain link 114 of the dryer chain 20 secures to the spindle radius 112. The front upper dryer chain 20, with the attached multi radius spindle shaft 82 rides between vertically oriented chain guide members 116 and 118 of the upper chain guide 24 during the initial stages of web threading. A pin 120 passes through a "U"-shaped special chain link 122 and the radius portion 106 of the multi radius spindle shaft 80. The "U"-shaped chain link 122 secures to the dryer chain 22. The upper rear dryer chain 22, with the attached multi radius spindle shaft 80, rides between vertically oriented chain guide members 124 and chain guide member 126 of the rear upper chain guide 32 during the initial web threading.

Figure 3:
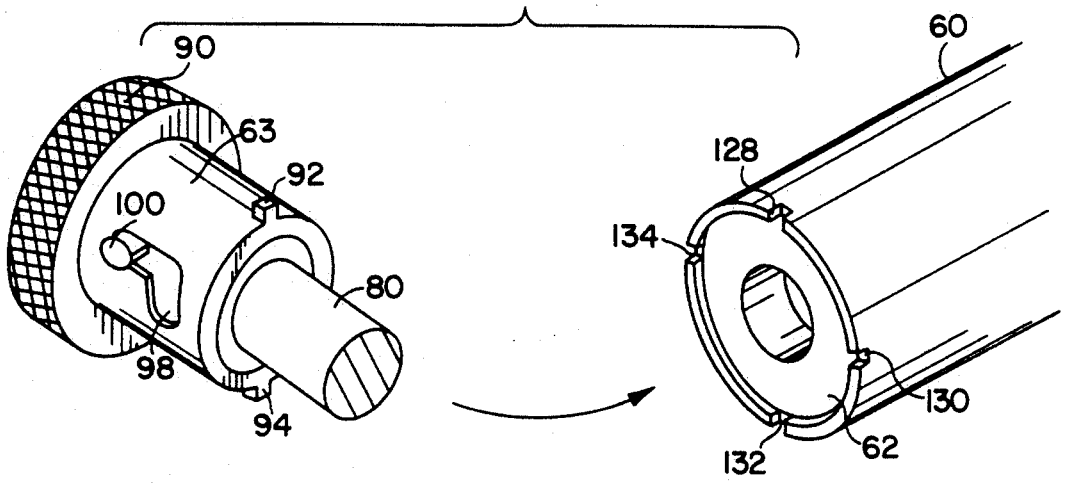
FIG. 3 illustrates a knurled lock up knob.

FIG. 3 illustrates the knurled lock up knob 90 where all numerals correspond to those elements previously described. Illustrated in particular are the grooves 128, 130, 132 and 134 in the cylindrical roll 60 spaced at 90 degree intervals. The locking tabs 92 and 94 can engage any opposing groove pair such as grooves 128 and 132 or 130 and 134, and are held in mutual engagement by the spring 102 as previously described for locking of the cylindrical roll 60 to the multi radius spindle shaft 80.

Figure 4:
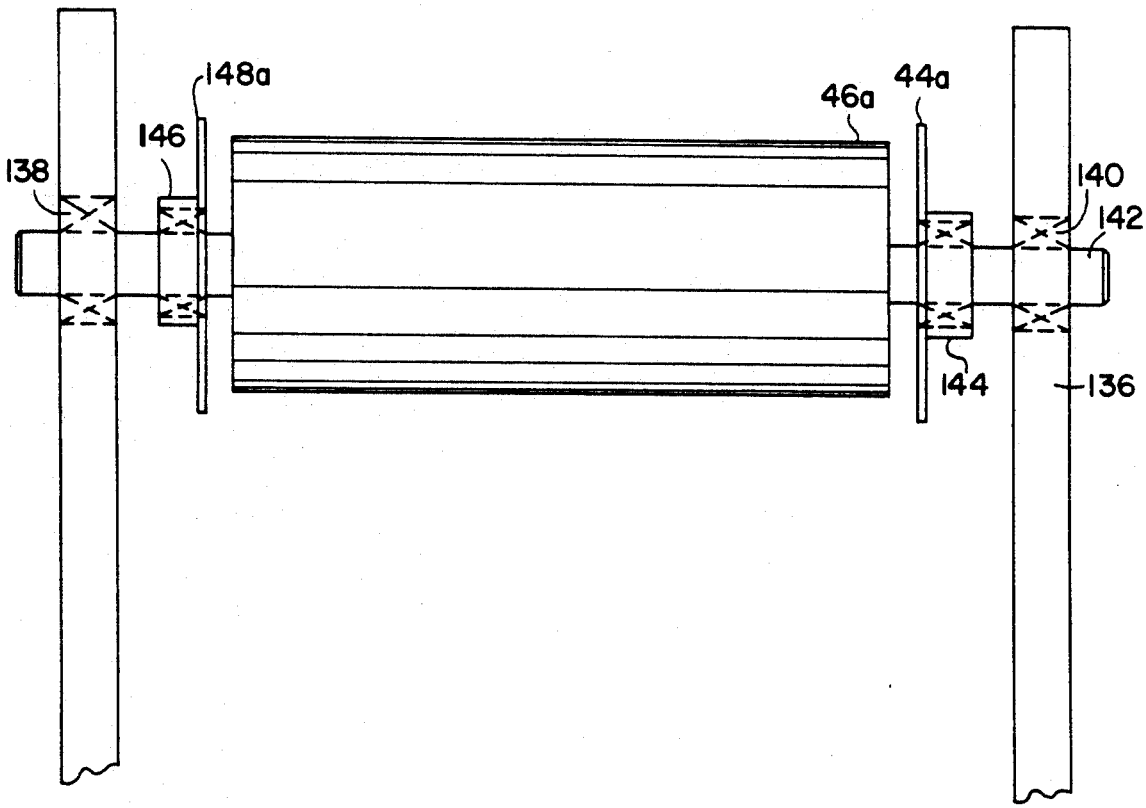
FIG. 4 illustrates a side view of a representative typical chill roll stand and chill roll sprocket.

FIG. 4 illustrates a side view of a representative optional chill roll 46a and a chill roll sprocket 44a where all numerals correspond to those elements previously described. The chill stand frame 136 includes frame mounted bearings 138 and 140. A shaft 142 extends through the bearings 138 and 140 mounted in the chill stand frame 136. A bearing 144 aligns over the shaft 142 between the chill roll frame 136 and the chill roll 46a. The sprocket 44a secures to the bearing 144. Both the bearing 144 and the attached sprocket 44a free wheel about the shaft 142, and between the chill roll 46a and the chill stand frame. A similar bearing 146 and sprocket 148a are located between the opposing end of the chill roll 46a and chill stand frame 136. The dryer chains 20 and 22 of FIG. 1 engage over the free wheeling sprockets 44a–44n which oppose a plurality of like sprockets 148a–148n.

Figure 5:
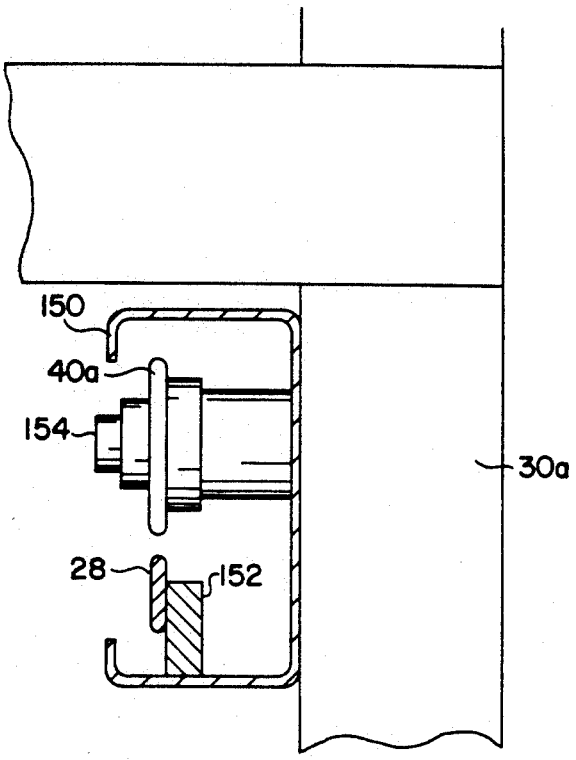
FIG. 5 illustrates a sectional view of the lower support rail along line 5—5 of FIG. 1.

FIG. 5 illustrates a sectional view of the lower support rail 28 along line 5—5 of FIG. 1 where all numerals correspond to those elements previously described. A channel 150 serves as a chain guard and secures to the dryer support legs 30a–30n. The horizontally aligned lower support rail 28 secures to a horizontally aligned bar member 152. The bar member 152 and lower support rail 28 secure to the lower portion of the channel 150. Also illustrated is the idler sprocket 40a and a shaft 154 which aligns with the lower support rail 28.

Figure 6:
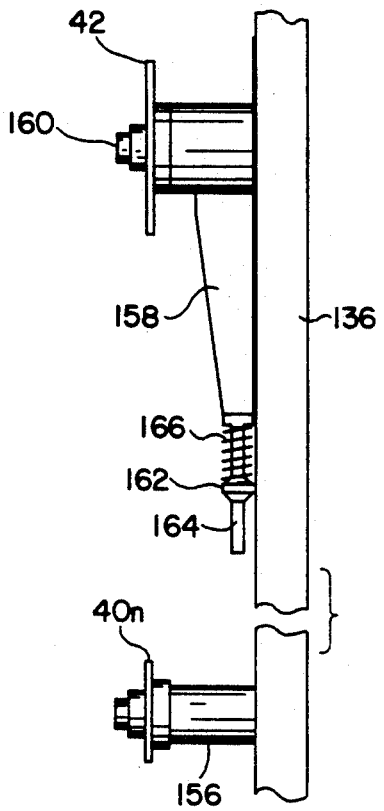
FIG. 6 illustrates a view of the take up sprocket and idler sprocket along line 6—6 of FIG. 1.

FIG. 6 illustrates a view of the take up sprocket 42 and the idler sprocket 40n along line 6—6 of FIG. 1 where all numerals correspond to those elements previously described. A shaft 156 extends perpendicularly from the chill stand frame 136. The idler sprocket 40n secures to the shaft 156. A sliding framework 158 aligns to the chill stand framework 136 as a mount for a sprocket shaft 160. A take up sprocket 42 secures to the shaft 160. A bracket 162 extends perpendicular from the chill stand framework 136. A threaded rod 164 extends through the bracket 162 and secures to the bottom of the sliding framework 158. A spring 166 aligns over the rod 164 between the bracket 162 and the sliding framework 158 to tension the dryer chain 20 of FIG. 1 which aligns over the take up sprocket 42 and the idler sprocket 40*n*.

Figure 7:
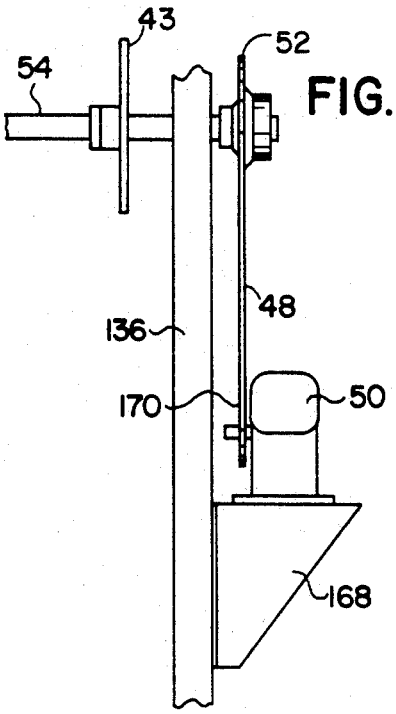
FIG. 7 illustrates a view of the drive shaft and drive shaft motor along line 7—7 of FIG. 1; and, FIG. 8 illustrates the attachment process of a web to the lock up roll threading bar.

FIG. 7 illustrates a view of the drive shaft 54 and drive motor 50 taken along line 7—7 of FIG. 1 where all numerals correspond to those elements previously described. A bracket 168 secures to the chill stand frame 136 to serve as a mount for the drive motor 50. A motor sprocket 170 drives the chain 48 and the drive shaft 54 via the torque limited sprocket 52. The drive sprocket 43 aligns over and secures to the shaft 54. The shaft 54 and sprocket 43 drives the dryer chain 20, and another similar sprocket which drives the other corresponding dryer chain 22 of FIG. 1.

Figure 8:
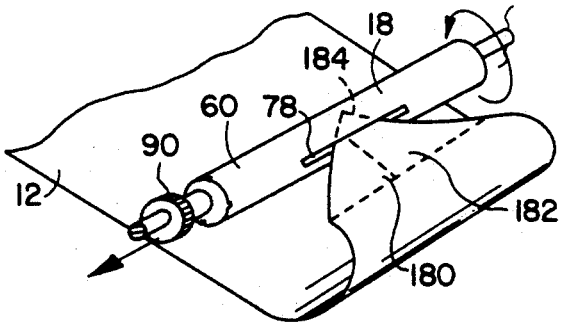

FIG. 8 illustrates the attachment of a web 12 to the lock up roll threading bar 18. Both corners 180 and 182 of the web 12 are folded under to form an angled end 184 which is inserted into the slot 78 of the lock up roll threading bar 18. The knurled lock up knob 90 is disengaged from the cylindrical roll 60 as previously described to allow the cylindrical roll 60 to free wheel so that several layers of the web may be wound about the cylindrical roll 60. The knurled lock up knob 70 is then re-engaged to lock the cylindrical roll 60 and prevent further rotation after the web is engaged into the cylindrical roll 60.

MODE OF OPERATION

FIG. 1 best illustrates one mode of operation with reference to FIG. 1 and the other FIGS. The web 12 is attached and locked to the lock up roll bar 18 as described in FIG. 8. The motor 50 is actuated, and the dryer chains 20 and 22 with the lock up roll bar 18, and the attached web end are cycled about the upper support rail system 24 and 32 and through the heated interior environment of the dryer 14. The lock up roll bar 18 and the attached web 12 travel the same path as the dryer chains 20 and 22 around and about the chill rollers 44*a*–44*n* to thread the chill stand 16. The lock up roll bar 18 and the attached web 12 proceed in their path around and about drive sprocket 43. The lock up roll threading bar 18 and attached web 12 then contact the limit switch 40*b* to halt operation of the motor 50 and of the travel of the lock up roll threading bar 18. The knurled lock up knob 90 is then disengaged to allow the cylindrical roll 60 to free wheel so that the cylindrical roll 60 can be manually rotated to disengage the wraps of web material from the cylindrical roll 60 for subsequent attachment to a roll. After transferring web reset threading bar to limit switch 40*b* and entering end of dryer by turning on drive again shaft 54, the take up sprocket 42, the idler sprocket 40*n*, the lower support rails 28 and 34, sprocket 40*a* adjacent to the rear face of the dryer 14 and chill stand 16 and the corresponding members adjacent to the rear faces of the dryer 14 and chill stand 16.

Various modifications can be made to the present invention without departing from the apparent scope hereof.

We claim:

1. Web threading system for a dryer comprising:
a. dryer;
b. parallel dryer chains about said dryer on guide rails;
c. a rotatable lock up roll threading bar means attached on each end to said parallel dryer chains; and,
d. means for attaching a web to said bar means for threading said web through said dryer.

2. The web threading system of claim 1, wherein said parallel dryer chains are also on idler sprockets.

3. Web threading system for a dryer and chill roll comprising:
a. a dryer;
b. a chill roll adjacent said dryer;
c. parallel chains about said dryer and said chill roll on guide rails;
d. a rotatable lock up roll threading bar means attached at each end to said parallel chains; and,
e. web affixed to said bar means for threading said web through said dryer and about said chill roll.

4. The web threading system of claim 3, wherein said parallel dryer chains are also on idler sprockets.

5. Process for threading a web through a dryer comprising the steps of:
a. inserting a web into a slot of a lock up threading are supported on each end to parallel dryer chains about said dryer guide rails;
b. rotating said lock up threading bar;
c. engaging a spring lock up means from an unlocked to a locked position;
d. running said lock up threading bar between said chains with said web through said dryer;
e. stopping said lock up threading bar with said web; and,
f. unwinding said web from said lock up threading bar.

6. The process of claim 5, wherein said parallel dryer chains are also on idler sprockets.

7. A web threading system for threading a web through a dryer comprising:
a. two parallel dryer chains;
b. shaft means mounted to each chain;
c. a roller mounted for rotatable movement, on the shaft means between the chains;
d. means for attaching a web to the roller; and
e. locking means for holding the roller in a fixed position of rotation, and for releasing the roller for free rotation about the shaft means.

8. Web threading systems for conveying a web comprising:
a. two parallel conveyor chains mounted on guide rails;
b. shaft means fixed to each chain;
c. a roller rotatably mounted on the shaft means between the chains;
d. a web-receiving slot in the roller for receiving a leading edge of a web;
e. a lock on the roller for allowing free rotation of the roller for loading and unloading the web and for locking the roller for holding the web during movement of the chains.

9. The web threading system of claim 8, wherein said parallel dryer chains are also on idler sprockets.

10. A web threading system for a dryer, comprising:
a. parallel chains about said dryer supported on guide rails; and
b. lock up roll threading bar means comprising: a cylindrical roll, said cylindrical roll mounted on a first bearing and a second bearing; first and second multi-radius spindle shafts aligned through said first and second bearings, respectively; means for locking said cylindrical roll to said first multi-radius spindle shaft; and chain guide members for guiding said cylindrical roll along said parallel chains.

11. The web system of claim 10, wherein said means for locking said cylindrical roll to said first multi-radius spindle shaft comprises a bored lock up knob having at least one locking tab, said lock up knob being slidingly engaged on a first portion of said spindle shaft through said bore, said locking tab being slidingly receivable by a corresponding grove in said cylindrical roll so as to lock said roll in said shaft.

12. The web threading system of claim 11, wherein said first multi-radius spindle shaft has a shaft portion of larger diameter than said first portion, and wherein said lock up roll threading bar means further comprises biasing means between said shaft portion of larger diameter and said lock up knob for urging said at least one locking tab into locking engagement with said corresponding groove in said cylindrical roll.

* * * * *